United States Patent [19]

Peters

[11] 4,157,128

[45] Jun. 5, 1979

[54] SELF-LOCKING HINGE

[76] Inventor: Jack Peters, 24008 Bessemer St., Woodland Hills, Calif. 91364

[21] Appl. No.: 863,568

[22] Filed: Dec. 22, 1977

[51] Int. Cl.[2] ..... E06C 7/50; E04C 1/383; E05C 17/54; E05D 11/10

[52] U.S. Cl. ..... 182/24; 16/144; 182/163; 292/339; 403/93

[58] Field of Search ..... 182/24, 23, 27, 163, 182/164; 403/93; 16/144; 292/263, 338, 339

[56] References Cited

U.S. PATENT DOCUMENTS

| | | | |
|---|---|---|---|
| 139,004 | 5/1873 | Hardenbrook et al. | 182/24 |
| 306,974 | 10/1884 | Stowe | 182/24 |
| 594,303 | 11/1897 | Ward | 182/24 |
| 790,653 | 5/1905 | Notthoff | 292/339 |
| 1,673,577 | 6/1928 | McGee | 403/93 |
| 1,679,513 | 8/1928 | Brown | 16/144 |
| 1,894,489 | 1/1933 | Hivose et al. | 182/27 X |
| 2,024,039 | 12/1935 | Harting | 182/27 |
| 2,798,249 | 7/1957 | Lukala | 16/144 |
| 3,583,743 | 6/1971 | Newell | 292/339 |

*Primary Examiner*—Benjamin W. Wyche
*Assistant Examiner*—Conrad L. Berman
*Attorney, Agent, or Firm*—Pollock, Vande Sande & Priddy

[57] ABSTRACT

A self-locking hinge for use as a pivotal connector between two pivoted members and adapted to lock the members in a fixed angular relation. The hinge comprises a pair of circular plates that are rigidly affixed to opposite faces of one member and rotatably connected to the other member. The circular plates are used to laterally support both of the members and to guide the other member as it is rotated from a folded position to a fully extended position. The hinge is locked in the fully extended position by means of a locking ring that is slidably engaged with the other member. When such other member is fully extended, the ring engages corresponding locking indentations at the periphery of the circular plates and thereby blocks the movement of the other member in one angular direction. The movement of the other member is blocked in the opposite angular direction due to the abutting of the hinge ends of the members. The members may be returned to the folded position by releasing the locking ring from its engagement with the indentations in the circular plates. The operation of the self-locking hinge of the invention is particularly described with respect to a door security apparatus adopted to engage a door and a floor to resist the opening of the door. A further embodiment uses the self-locking hinge of the invention to provide a means to convert a stepladder to a straight ladder of increased height.

29 Claims, 9 Drawing Figures

SELF-LOCKING HINGE

BACKGROUND OF THE INVENTION

The invention relates to a self-locking hinge and, more particularly, to such a hinge including means to provide support for axial members attached to the hinge and to lock the hinge in a position that resists damage to the hinge when force is applied to the axial members.

Prior art hinges have not combined the simplicity of operation, ability to withstand stress, and locking capabilities of the present invention. The patent to McGee, No. 1,673,577, is an example of a prior art circular plate locking hinge that is not resistant to stress. The circular plate hinge of McGee pivots at a single point and uses a sliding ring with a locking tab to engage a notch in the plate to lock the hinge in position. The use of a single pivotal point renders the McGee hinge susceptible to damage when force is applied since the force is concentrated at a single point rather than distributed over the hinge. In addition, the McGee locking tab is a structurally weak means to lock the hinge since the tab itself must resist any angular force that is applied to the hinge.

Accordingly, it is an object of the invention to provide a simple and effective means to distribute the forces applied to a hinge to minimize the force-induced strain on the components of the hinge.

A further object of the invention is to provide a hinge locking means that is not dependent upon the strength of a single locking component.

Another object of the invention is to provide a hinge that will laterally support extending hinge members and will not pivot the members about a single stress-sensitive pivot point.

A further object of the invention is to provide a more durable hinge that includes stationary hinge guide plates rather than movable plates that are more susceptible to damage.

A further object of the invention is to provide locking hinge embodiments that utilize a pivotal connection lockable in a force resistant position.

These and other objects of the invention will become apparent from a review of the detailed specification which follows and a consideration of the accompanying drawings.

BRIEF SUMMARY OF THE INVENTION

In order to achieve the objects of the invention and to overcome the problems of the prior art, the self-locking hinge, according to the present invention, includes a pair of circular hinge plates that are rigidly affixed to a support hinge member and rotatably connected to a pivotal hinge member. The stationary plates and the separate pivotal point for the pivotal member reduce the effect of stress on the hinge when force is applied to the members, since the resultant force is not applied to a single pivotal point but is distributed over the surface of the circular plates.

A locking ring is slidably engaged with the pivotal member and is adapted to slide into corresponding indentations of the circular hinge plates when the pivotal member is fully extended at an angular relation of 180 degrees with respect to the support member. The corresponding identations of the discs have a single vertical wall that blocks the movement of the pivotal member in one direction when the ring is engaged with the indentations. Since the body of the ring is engaged with the indentation, movement of the pivotal member is blocked by the inherent strength of the ring itself. In addition, the strength of the ring is enhanced due to its slidable connection with the pivotal member.

The movement of the pivotal member is blocked in an opposite direction due to the abutting of the ends of the support member and the pivotal member when the pivotal member is fully extended. Thus, the engaged ring and the abutted end surfaces completely block the movement of the pivotal member. The hinge area of the pivotal member and the support member are laterally supported by the circular plates, and any forces that are applied to the hinge members are distributed over the rigid members themselves or the sturdy circular discs.

An embodiment of a door security device that includes the self-locking hinge of the invention is also disclosed. The upper member of the door security hinge is adapted to adjustably extend in an axial direction to engage the doorknob of a closed door, and the lower support member of the hinge is adapted to axially extend to engage the floor. When the door security device is locked in the extended position, it provides a means to resist the application of an opening force to the door.

Thus, if an opening force is applied to the door, the force is transmitted from the inside doorknob through the upper and lower hinge members to the floor. As is apparent from the above discussion, the structure of the hinge is adapted to withstand large forces applied to the members and therefore strongly resist any opening force that is applied to the door. In addition, unlike the more bulky and complicated prior art door security devices, the door security device of the present invention can be easily and quickly removed from its engagement with the door to allow an emergency exit, if necessary. Furthermore, a rubberized foot member of the device provides an exceptional frictional engagement with the floor when the device is engaged with the door and also ensures that the floor is not marred when the device is in use. Finally, due to the pivoting of the hinge, the door security device can be easily folded up when not in use and, in the folded position, it can easily be stored for later use or can be carried in a small suitcase to be used to secure hotel room doors, for example, when one is traveling.

The self-locking hinge of the invention is also included in an embodiment of an improved collapsible stepladder that may be converted to a straight ladder of increased length. The ladder employs self-locking hinges to pivotally connect a step side and a support side of the ladder in a normal stepladder position. The support side of the ladder is provided with steps that are not used when the ladder is in the normal position but that are used when the support side is pivoted and locked at an angle of 180 degrees with respect to the step side.

The self-locking hinges are attached to the pivotal ends of corresponding opposite step rails and support rails to provide a pivotal connection for folding the ladder, and for defining a normal or extended stepladder position. In the extended straight ladder position, locking rings block the angular movement of the pivotal support rails of the ladder in a folding direction and the abutting ends of corresponding opposite step and support rails of the ladder block the angular movement of the support rails in an opposite direction. Thus, the locked hinges provide rigid connections that are resistant to stress on the pivotal and support members of the ladder while the ladder is in the extended position.

It should be readily apparent from the above discussion that the self-locking hinge of the invention is not limited to the described embodiments. Indeed, the hinge is well adapted for use whenever a strong, force-resistant, pivotal connection is required and is particularly suited to applications that require a locking engagement of axial hinged members at 180 degrees. For instance, the hinge could be easily used by those skilled in the art to construct an extendable tree trimming pole or to provide a simple and reliable means to lock an extending antenna in an upright direction. In addition, the hinge could be used to provide sturdy and rigid joint connections of the type used in scaffolding.

DETAILED DESCRIPTION OF PREFERRED EMBODIMENTS

Figure 1:
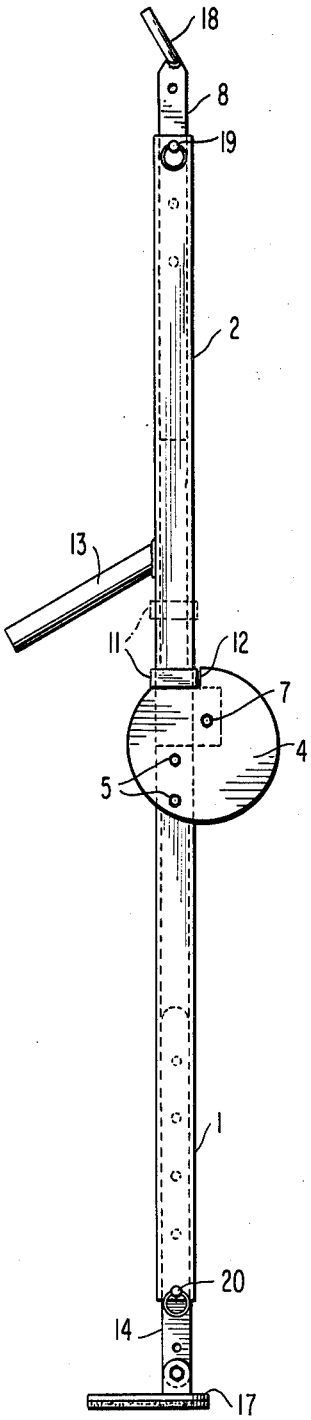
FIG. 1 shows a side view of the extended door security apparatus.

The remaining portion of this specification will describe preferred embodiments of the invention when read in conjunction with the attached drawings, in which like reference characters identify identical apparatus.

Figure 6:
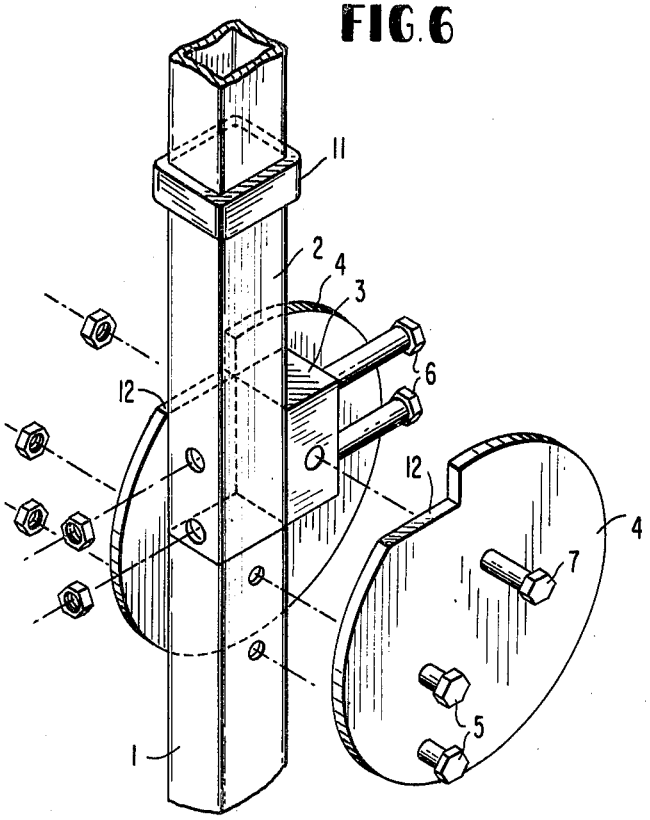
FIG. 6 shows an exploded view of the self-locking hinge of the invention.

FIG. 6 illustrates the construction of a self-locking hinge in accord with the present invention. As shown in FIG. 6, a lower support tube 1 is connected to an upper pivotal tube 2 by the interconnection of a mounting block 3 and circular guide plates 4.

The lower support tube 1 is rigidly affixed to the circular guide plates 4 by means of support hinge bolts 5. The mounting block 3 is attached to a lateral face of the upper pivotal tube 2 by means of mounting block bolts 6, and the mounting block is pivotally connected to guide plates 4 by means of a pivotal hinge bolt 7. The upper and lower tubes are positioned with respect to the guide plates 4 so that when the pivotal tube 2 is fully extended at an angle of substantially 180 degrees with respect to the lower support tube 1, the respective ends of the tubes abut one another. Thus, the pivotal tube 2 is adapted to pivot from a fully folded position to a fully extended position that is defined by the abutting of the ends of the tubes.

Figure 2:
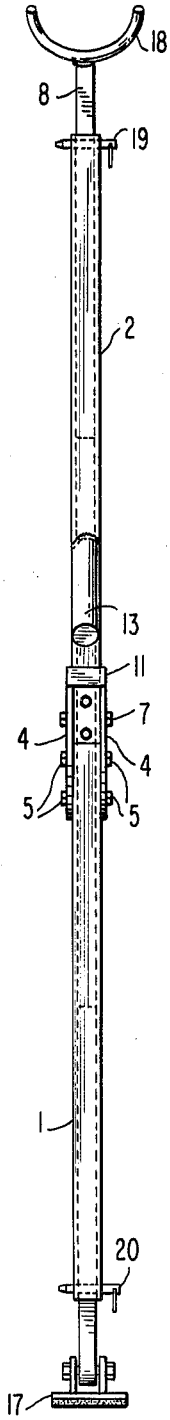
FIG. 2 shows a front view of the extended door security apparatus.
Figure 3:
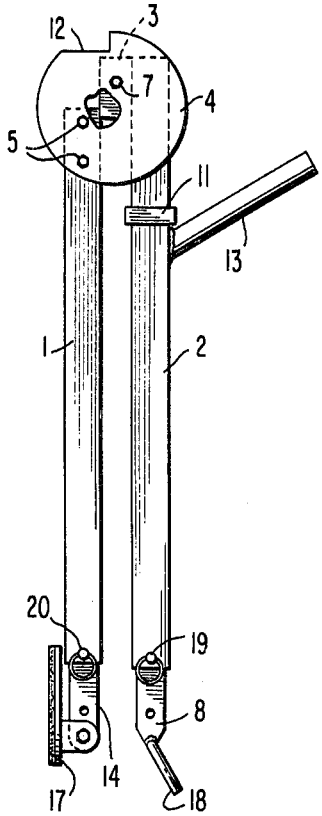
FIG. 3 shows a side view of the folded door security apparatus.
Figure 4:
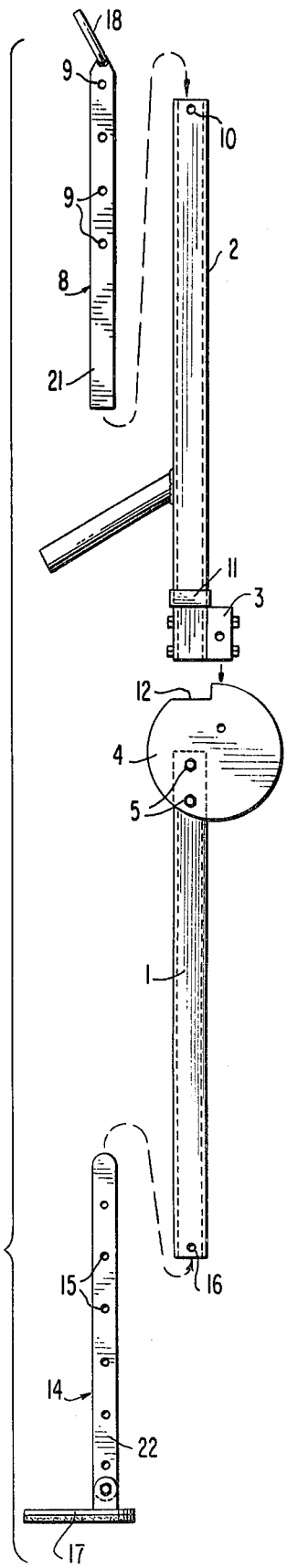
FIG. 4 shows a side view of the engaged door security apparatus.

The relative movement of the components of the hinge and the locking action of the hinge is shown in the illustrations of a door security embodiment in FIGS. 1–5. In FIG. 4, the upper pivotal tube 2 is connected to the mounting block 3 as explained above, and is telescopically engaged with an extendable door engaging member 8. The door engaging member 8 includes an upper rectangular bar 21 that is dimensioned so that it can easily slide within tube 2. Holes 9 are drilled at intervals along the bar 21 and a hole 10 is drilled near the top end of the tube 2. When member 8 is slidably engaged with tube 2, the extension of member 8 may be adjusted by aligning the hole 10 with a particular hole 9 and inserting a locking pin 19, as shown in FIG. 2, through the aligned holes to fix the position of the member 8. Of course, the adjustable extension means disclosed herein is for illustrative purposes only and other extension means known to the art could be used to accomplish the same purpose.

As shown in FIG. 4, a locking ring 11 encloses tube 2 and is adapted to slide along the axis of tube 2 to engage corresponding locking indentations 12 in the guide plates 4 when the pivotal tube 2 is locked in the fully extended position.

A tubular handle 13 is attached at a point above the mounting block 3 to the upper pivotal tube 2, for instance by welding, and provides a means to force the door security device into a locked position. The handle 13 and the top of the mounting block 3 define a sliding area for the locking ring 11.

The bar portion 22 of a lower extendable foot member 14 is dimensioned to slide inside of the lower support tube 1 and to thereby provide an adjustable extension means to engage a floor. Holes 15 are provided in the bar portion 22 and a hole 16 is provided near the end of the tube 1. The extension of the foot member 14 is adjusted by aligning a particular hole 15 with the hole 16 and inserting a locking pin 20 through the aligned holes to fix the extended foot member 14 in position.

A pivotal foot 17 is pivotally attached to the free end of the bar portion 22 of the extendable foot member 14 so that the foot 17 may frictionally engage the floor when the door security device is locked in position. The pivotal attachment point is closer to the front of the foot in order to permit the large surface area at the rear of the foot to frictionally contact the floor when the door security device is positioned. A rubberized or other nonslip material is adhered to the bottom of the foot in order to provide a strong frictional contact between the foot and the floor.

A tubular U-shaped yoke 18 is attached to the top bar portion 21 of the door engaging member 8, for instance by welding, to enable the member 8 to engage a doorknob on a closed door when the door security device is in a locked relation with respect to the door.

Figure 5:
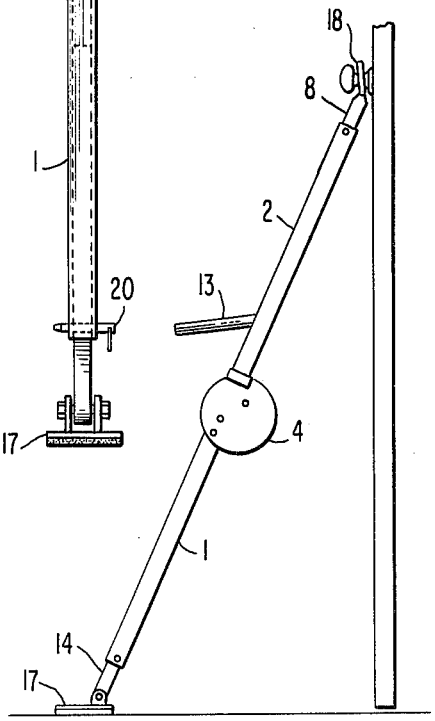
FIG. 5 shows an exploded view of the hinge and extender components of the door security apparatus.

In operation, the hinge of the door security device provides for a pivotal movement of the tube 2 from a folded position, as illustrated in FIG. 3, to a fully extended locked position as illustrated in FIGS. 1 and 5. As shown in FIG. 3, in the fully folded position the tube 2 is pivoted about the pivotal bolt 7 until the mounting block 3 contacts the surface of the lower support tube 1. The separation of the upper tube 2 from the lower tube 1 by the mounting block 3 in the fully folded position facilitates the handling of the unit when it is collapsed.

When the tube 2 is pivoted from the fully folded position to the fully extended position, the ring 11 slides along the outer periphery of the plates 4 until the tube 2 is fully extended and the ring 11 is engaged with the indentations 12. It is noted that at all times during the rotation of the upper pivotal tube 2, a portion of the lower support tube 1 and the pivotal tube 2 remains within the confines of both circular guide plates 4, thereby ensuring that both tubes are laterally supported by the guide members 4 so that the strain on the hinges is minimized.

As shown in FIG. 1, in the locked position the body of the ring 11 fully engages the indentations 12 to prevent angular movement of the pivotal tube 2 in the folding direction. The movement of the pivotal tube 2 in an opposite angular direction is blocked by the abutting of the hinge ends of the tube 2 and the tube 1. Thus, in the locked position, the tubes are rigidly held in place by the inherent strength of the ring 11, the large indentations 12, and pressure on the abutting tubes themselves. In addition, it is noted that the overlap of the plates 4 with the upper tube 2 and the lower tube 1 and the skewing of the pivotal point of tube 2 from the stationary attachment points of tube 1 contribute to the dissipation of forces applied to tubes 2 and 1 and thereby ensure added durability of the hinge of the invention.

FIG. 5 illustrates the operation of the door security device. The device is initially positioned at an angular relation intermediate the fully folded and locked positions by adjusting the extension of the door engaging member 8 and the foot member 14 so that the yoke 18 is secured under a doorknob of a closed door and the pivotal foot 17 is contacting the surface of the floor. A downward force is then applied to the handle 13 to move the pivotal tube 2 from its intermediate angular position to a fully extended locked position.

In the locked position, the distance between the yoke 18 and the pivotal foot 17 is maximized and the counterforce that is applied through the tubes 2 and 1 to the door is likewise maximized. Once the door security device is locked in position, it is apparent that the device will resist the opening of the door by providing a counterforce to any force that is applied to open the door. As is apparent from the above discussion, the door security device, according to the present invention, will counter the door opening force without unduly straining the hinge components of the device. In particular, it is noted that the abutting ends of the upper tube 2 and the lower tube 1 provide a means to transfer the applied door opening force directly through the tubes and to thereby avoid placing any portion of the force on the components of the hinge. Thus, the resistance of the door security device is maximized and the problem of hinge failure due to excessive door opening force is avoided. In addition, the device may be easily and quickly disengaged from the door by pressing on the handle 13 and disengaging the locking ring 11 from the indentations 12.

It is noted that prior art hinges do not provide such a means to eliminate strain on the hinge and thus cannot maximize the ability of a door prop device to resist the application of a door opening force. In addition, prior art devices cannot be so easily and quickly disengaged from the door.

Figure 9:
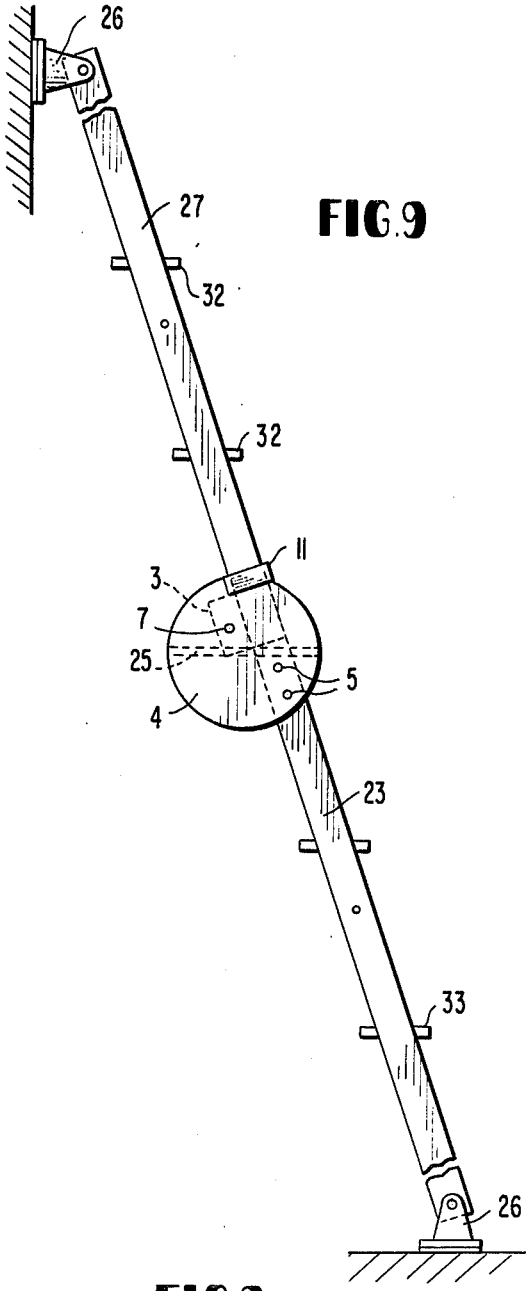
FIG. 9 shows a side view of the improved ladder in the extended position.
Figure 7:
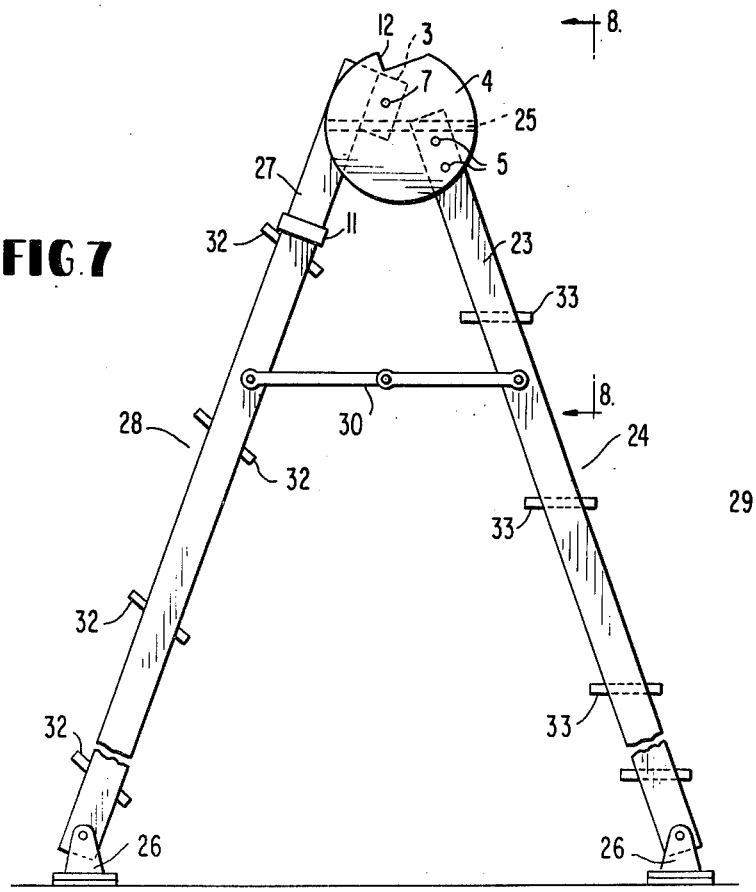
FIG. 7 shows a side view of the improved stepladder in a normal stepladder position.
Figure 8:
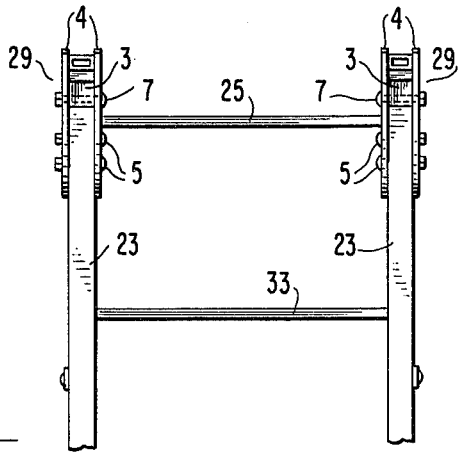
FIG. 8 shows a front view of a top portion of the improved ladder in the normal position.

A second embodiment of the present invention is illustrated in FIGS. 7–9. FIG. 7 illustrates the use of the hinge of the invention in a stepladder that is adapted to be converted into a straight ladder of increased height. As shown in FIG. 8, a hinge assembly 29 is provided for each of the stationary step rails 23 that make up the step side 24 of the ladder. The rails 23 are affixed to their respective circular guide plates 4 by the associated bolts 5. As shown in FIG. 7, the corresponding opposite pivotal support rails 27 on the support side 28 of the ladder are attached to their respective mounting blocks 3. The mounting blocks 3 are pivotally connected to their respective guide plates 4 by means of associated pivotal hinge bolts 7. Thus, each hinge assembly 29 connects a particular stationary rail 23 on the step side 24 of the ladder to an opposite pivotal support rail 27 on the support side 28 of the ladder.

As shown in FIG. 8, the inside guide plates of the hinge assemblies are connected by a hinge step 25 that may be affixed to each plate by welding. In addition, it is noted that the support rails 27 are cross-connected by support steps 32 that are oriented in an upside-down direction when the ladder is in a normal stepladder position, as illustrated in FIG. 7. In the normal ladder position, the steps 33 on the step side 24 are, of course, oriented in their normal upright step position.

The ladder is maintained in the normal step position by cross-support bars 30 that each connect a particular stationary rail 23 with an opposite support rail 27. The cross-support bars 30 are adapted to extend to define a normal ladder position and to pivotally collapse to allow folding of the ladder.

A locking ring 11 is slidably engaged with each of the support rails 27 between the top step of the support rails and the hinge assembly. Since the inside diameter of the ring is slightly larger than the outside diameter of the support rail, the ring is able to freely slide within the area defined by the top step of the support rail and the hinge assembly.

Thus, in the normal stepladder position the rings 11 are disengaged from their associated guide plates 4, each stationary rail 23 is at an intermediate angular relation with its associated opposite support rail 27, and the extended cross-support bars 30 fix the ladder in position. It is obvious from the above that when the ladder is in the normal stepladder position, the steps 33 on the step side 24 are used to climb the ladder.

FIG. 9 illustrates the relation of the components of the improved ladder when the ladder is in the extended straight ladder position. The ladder is moved to the straight ladder position by disengaging the cross-support bars 30 from their respective stationary rails 23 and support rails 27. The engagement or disengagement of the cross-support bars with the rails of the ladder can be accomplished by means well known to the art. For instance, the ends of the cross-support bars could be bolted to the appropriate rails in the normal stepladder position and the bolts could be removed to disengage the cross-support bars in the extended straight ladder position.

When the cross-support bars 30 have been disengaged, the pivotal support rails 27 are rotated about the pivotal bolts 7 of their respective hinge assemblies 29. As the pivotal support rails are rotated, the rings 11 ride on the outer periphery of their respective guide plates 4 and, when the support rails 27 are fully extended and the angular relation between the support rails 27 and their associated step rails 23 is substantially 180 degrees, the locking rings 11 drop into engagement with their respective guide plate indentations 12.

As shown in FIG. 9, the engagement of the rings 11 with the indentations 12 blocks the angular movement of the pivotal support rails 27 in a folding direction. The movement of the support rails 27 in an opposite direction is blocked by the abutting of the hinge ends of the step rails 23 with their respective opposite support rails 27. Thus, the locking rings and the abutting ends of the rails completely block the angular movement of the pivotal support rails 27. As shown in FIG. 9, when the support rails 27 are in the extended and locked straight ladder position, the support steps 32 are properly oriented to allow climbing of the upper support section of the extended ladder.

Surface engaging feet 26 are pivotally connected to the free ends of the stationary rails 23 and the support rails 27. In the extended locked position, as shown in FIG. 9, the feet on the stationary rails 23 are adapted to frictionally engage the ground and the feet on the support rails 27 are adapted to frictionally engage the surface against which the extended ladder is leaning. FIG. 7 illustrates the ground engagement of all of the pivotal feet when the ladder is in the normal stepladder position.

Thus, as explained above, the self-locking hinge of the invention provides a means to convert a stepladder to an extended straight ladder of increased height and, more importantly, provides a hinge means that is resistant to the damaging effects of stress in a locked position.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. A self-locking hinge for use as a pivotal connector between a support member and a pivotal member and adapted to lock said members in a fixed angular relation, said hinge comprising:

a guide means rigidly affixed to opposite lateral faces of said support member to laterally support said support member and rotatably connected to said pivotal member to slidably engage opposite lateral faces of said pivotal member to laterally support and to guide said pivotal member when the pivotal member is pivoted about said rotatable connection; and a locking means for engaging said guide means to block the angular movement of said pivotal member to lock said support member and said pivotal member in a fixed angular position.

2. The self-locking hinge of claim 1, wherein said pivotal member comprises a mounting block rotatably connected to said guide means, and an axial member affixed to said block.

3. The self-locking hinge of claim 2, wherein said mounting block is interposed between said axial member and said support member to separate said members when the members are folded together.

4. The self-locking hinge of claim 2, wherein said locking means includes a locking guide element adapted to engage said guide means to block the movement of said axial member in one angular direction, and hinge ends of said axial member and said support member engaged in abutting relation to block the movement of said axial member in an opposite angular direction, to lock said support member and said axial member in a fixed angular relation.

5. The self-locking hinge of claim 4, wherein said fixed angular relation is substantially 180 degrees when said axial member is rotated from a collapsed position to a fully extended position.

6. The self-locking hinge of claim 4, wherein said guide means includes a first plate rigidly affixed to a lateral face of said support member near the hinge end thereof, and rotatably connected to a corresponding face of said mounting block, and a second plate operatively associated with said first plate and rigidly affixed to an opposite lateral face of said support member and rotatably connected to a corresponding opposite face of said mounting block.

7. The self-locking hinge of claim 6, wherein said plates extend to cover a portion of said support member and said axial member to laterally support said members.

8. The self-locking hinge of claim 6, wherein said first and second plates are circular in shape.

9. The self-locking hinge of claim 8, wherein a horizontal center line of said circular plates lies on a plane defined by said abutting surfaces of the hinge ends of said support member and said axial member.

10. The self-locking hinge of claim 6, wherein each of said plates includes a corresponding peripheral indentation that is adapted to receive said locking guide element to engage said plates and said guide element.

11. The self-locking hinge of claim 10, wherein said locking guide element includes a ring that is slidably engaged with said axial member and adapted to slide along the axis of said member to engage the indentations of said plates.

12. The self-locking hinge of claim 11, wherein said axial member includes a handle that is affixed to said member above said mounting block to define an area of sliding motion for said ring along said axial member between said handle and said block.

13. The self-locking hinge of claim 11, wherein said ring is adapted to slide along the periphery of said circular plates when said axial member is rotated intermediate a collapsed position and a locking position, said ring engaging corresponding peripheral indentations in said plates when said axial member is rotated to a locking position.

14. A collapsible door security apparatus for use as a prop between the inside surface of a closed door and a floor to resist the opening of the door, said apparatus comprising:

door engaging means for adjustably extending to engage an inside surface of said closed door;

foor engaging means for adjustably extending to engage an area of said floor;

pivoting means affixed to said door engaging means adjacent a hinge end thereof to define a pivot point for said door engaging means;

guide means rigidly affixed at a hinge end of said floor engaging means to laterally support the hinge end of said floor engaging means and rotatably connected to said pivoting means to slidably engage the hinge end of said door engaging means to laterally support and to guide said door engaging means when said door engaging means is pivoted about said pivot point; and a locking means for blocking the angular movement of said door engaging means to hold said door engaging means in a fixed angular relation with said floor engaging means, to maintain the engaged relation of said floor engaging means and said door engaging means with said floor and door.

15. The apparatus of claim 14 wherein said floor engaging means comprises a lower support means for defining an axially extending support section of fixed length;

a lower bar means telescopically cooperating with the lower support means for adjustably extending to define an axially extending support section of variable length; and a foot means pivotally affixed to the end of said bar for frictionally engaging said floor.

16. The apparatus of claim 14 wherein said pivoting means is a mounting block affixed to a lateral face of said door engaging means at the hinge end thereof.

17. The apparatus of claim 16 wherein said mounting block is interposed between said door engaging means and said floor engaging means to separate said floor engaging means and said door engaging means when they are folded together.

18. The apparatus of claim 16 wherein said door engaging means comprises an axial means for defining an axially extending door engaging section of fixed length an upper bar means telescopically cooperating with the axial means for adjustably extending to define an axially extending door engaging section of variable length and a yoke means affixed to the end of said upper bar means to engage a doorknob on said door.

19. The apparatus of claim 16 wherein said guide means includes a first circular plate rigidly affixed to a lateral face of said floor engaging means at the hinge end thereof, and rotatably connected to a corresponding face of said mounting block, and a second circular plate operationally associated with said first plate and rigidly affixed to an opposite face of said floor engaging means and rotatably connected to a corresponding opposite face of said mounting block.

20. The door security apparatus of claim 19, wherein said locking means comprises:

a ring slidably attached to said door engaging means and adapted to slide along the axis of said door engaging means to engage corresponding indentations in said plates to block the movement of said door engaging means in one angular direction, and hinge ends of said door engaging means and said floor engaging means engaged in abuting relation to block the movement of said door engaging means in an opposite angular direction, to lock said floor engaging means and said door engaging means in a fixed angular relation.

21. The apparatus of claim 20, wherein a horizontal center line of said circular plates lies on a plane defined by said abutting surfaces of the hinge ends of said floor engaging means and said door engaging means, when said door engaging means is rotated from a collapsed position to a fully extended position and said fixed angular relation to said fully extended door engaging means and floor engaging means is substantially 180 degrees.

22. The apparatus of claim 20, wherein said door engaging means includes a handle that is affixed to said door engaging means above said mounting block to define an area of sliding motion for said ring along said door engaging means between said handle and said block.

23. An improved collapsible stepladder for use as a normal stepladder and convertible to a straight ladder with an increased climbable height, said improved stepladder comprising:

a step side means having first and second step rails connected by a plurality of spaced step members therebetween to provide a climbing surface;

a pivotal support side means having first and second pivotal support rails connected by a plurality of spaced support steps therebetween, said pivotal support side supporting said step side to provide a stable structure climbable on said step side in a stepladder position and pivotally extending to define an extended climbable surface with said step side in a converted straight ladder position;

first guide means rigidly affixed to opposite lateral faces of said first step rail to laterally support said first step rail and rotatably connected to an operatively associated first pivotal support rail to slidably engage opposite lateral faces of said first pivotal support rail to laterally support and to guide said first pivotal support rail when the pivotal support side of said stepladder is pivoted;

second guide means rigidly affixed to opposite lateral faces of said second step rail to laterally support said second step rail and rotatably connected to an operatively associated second pivotal support rail to slidably engage opposite lateral faces of said second pivotal support rail to laterally support and to guide said second pivotal support rail when the pivotal support side of said stepladder is pivoted;

locking means for locking said support side and said step side in a fixed angular relation of substantially 180 degrees to define a straight ladder of increased climbable height; and collapsible cross support means connecting said first step rail with said first pivotal support rail and said second step rail with said second pivotal support rail to define a folded stepladder position when said cross support means is collapsed and a climbable stepladder position when said cross support means is fully extended, said cross support means having means to disconnect the associated step rails and pivotal support rails to allow said pivotal support side to pivot to the straight ladder position.

24. The improved stepladder of claim 23 wherein each of said pivotal support rails has a mounting block affixed to its lateral face at the hinge end thereof.

25. The improved stepladder of claim 23, wherein said support steps are upside-down when said improved ladder is in the normal stepladder position.

26. The improved stepladder of claim 23, wherein said support rails and said step rails include pivotal feet at the free ends thereof, for frictionally engaging a corresponding ladder support surface.

27. The improved stepladder of claim 24 wherein each of said guide means includes:

an outer guide plate rigidly affixed to an outside lateral face of a step rail at the hinge end thereof, and rotatably connected to a corresponding face of the mounting block of the associated pivotal support rail, for laterally supporting said rails and slidably engaging said pivotal support rail to guide the support rail when the rail is pivoted about the rotatable connection;

an inner guide plate operatively associated with said outer guide plate and rigidly affixed on one side to an inside lateral face of said step rail and rotatably connected on said side to a corresponding face of the mounting block of said associated support rail to cooperate with said outer plate to laterally support said rails and guide said pivotal support rail; and a locking ring slidably attached to said associated pivotal support rail near a hinge end thereof and adapted to slide along the axis of said rail to engage corresponding indentations in said inner and outer plates to block the angular movement of said support rail in one direction when said support rail is rotated to a fully extended position defined by an angular relation of said support rail and said step rail of substantially 180 degrees.

28. The improved stepladder of claim 27, wherein the movement of said support rail is blocked in an opposite direction by the abutting of hinge ends of said support rail and the associated step rail when said support rail is fully extended.

29. The improved stepladder of claim 27, wherein the inner guide plates of the first guide means and the second guide means are connected by a hinge step.

* * * * *